United States Patent [19]

Lorenzini

[11] 4,296,668

[45] Oct. 27, 1981

[54] REED PROTECTOR FOR A WOODWIND INSTRUMENT

[76] Inventor: Robert A. Lorenzini, P.O. Box 91, Hancock, Mass. 01237

[21] Appl. No.: 143,753

[22] Filed: Apr. 25, 1980

Related U.S. Application Data

[63] Continuation-in-part of Ser. No. 967,989, Dec. 11, 1978, abandoned.

[51] Int. Cl.[3] ..... G03D 9/02

[52] U.S. Cl. ..... 84/383 R; 84/385 R

[58] Field of Search ..... 84/380 R, 382, 383 R, 84/383 A, 385 R, 453, 458

[56] References Cited

U.S. PATENT DOCUMENTS

| | | | |
|---|---|---|---|
| 425,521 | 4/1890 | Renzenbrink | 84/383 |
| 1,016,055 | 1/1912 | Winquist | 84/383 |
| 1,410,066 | 3/1922 | Knope | 84/383 |
| 1,495,322 | 5/1924 | Greene et al. | 84/383 |
| 1,680,159 | 8/1928 | McVicker | 84/458 |
| 2,502,558 | 4/1950 | Costello | 84/383 |
| 2,600,853 | 6/1952 | Crescenzi | 84/383 |

FOREIGN PATENT DOCUMENTS

| | | | |
|---|---|---|---|
| 54389 | 4/1890 | Fed. Rep. of Germany | 84/383 |
| 423717 | 4/1911 | France | 84/383 |
| 996356 | 12/1951 | France | 84/383 |
| 22 | of 1878 | United Kingdom | 84/383 |

*Primary Examiner*—L. T. Hix
*Assistant Examiner*—Alan Mathews
*Attorney, Agent, or Firm*—Richard A. Menelly

[57] ABSTRACT

A reed protector for a woodwind instrument supported by a sleeve separate from the ligature which is used to hold the reed in place. A sleeve is provided with a pair of parallel protrusions extending from it, which protrusions have inner surfaces which face each other. A cap is pivotably mounted at one end on the protrusions and is held in a protective position by one set of lugs on the pivot member and in a playing position by a second set of lugs. The cap contains a foam material at its free end which aids in keeping the reed moist when the cap is in the protective position. Additionally, the cap may be used to carry an extra reed therein.

2 Claims, 7 Drawing Figures

REED PROTECTOR FOR A WOODWIND INSTRUMENT

BACKGROUND OF THE INVENTION

This is a continuation-in-part of application Ser. No. 967,989, filed Dec. 11, 1978, now abandoned.

The present invention relates to a reed protector for a woodwind instrument.

Protective devices for the mouthpieces of woodwind instruments are known. Whenever the protector is secured to the instrument, it is usually mounted on a ligature or reed-holding device. Therefore, if a musician desires to use such a protective cap, the musician is required to also use the particular ligature provided. Apparently, for this reason, musicians, despite the fact that mounted protective caps are known, utilize a sleeve or tubular member to place over the instrument when not in use. Unfortunately, such a device is readily misplaced during playing of the instrument. Therefore, the cap is not always placed back on the mouthpiece of the instrument after use, resulting in damage to the reed. It is also essential that such a reed protector be easily and inexpensively produced while also being durable.

The Winquist Patent, U.S. Pat. No. 1,016,055, teaches the use of a ligature which includes a protective cap. The protective cap is pivotably mounted and includes two retaining members on the outside of a protrusion of the ligature in order to hold the protective cap both in a protective position and approximately 180 degrees in the opposite direction when the instrument is being used.

The Knopf Patent, U.S. Pat. No. 1,410,066, shows a protective cap mounted off center on a ligature. Tension is achieved by thumbscrews utilized to hold the protector cap in any selected position.

The McVicker Patent, U.S. Pat. No. 1,680,159, shows a protective device attached to a ligature and includes a clipping device. The protective cap is slid backwards and then swung around on a single pivot to remove it from the protective position to the playing position.

The Costello Patent, U.S. Pat. No. 2,502,558, teaches a protective cap mounted on a ligature which when swung out of place extends downwardly from the instrument and which does not extend out of the way along the instrument.

The Crescenzi Patent, U.S. Pat. No. 2,600,853, shows a cap slidably mounted on a ligature.

None of these patents pertain specifically to a simple protective cap located adjacent the ligature toward the outer end of the instrument but independent of the ligature. Also, none of these patents teach a simple and inexpensive reed protector for woodwind instruments that can be readily produced.

Further, it is desirable in many instances to provide means in a protective cap to aid in keeping the reed moist. This is especially desirable in the case of a musician who is a doubler, that is one who plays more than one instrument during an evening's performance. If one instrument is a woodwind, the reed often becomes dry during the playing of the other intrument. Obviously, the same problem occurs during intermissions. By providing a means to keep the reed moist when the reed protector cap is in the protective position, the problem can be overcome. Also, it is possible to use the protector cap of this invention to carry an extra reed. Of course, the moistening means can be used to help keep the extra reed in a moist condition.

These and various other problems were not satisfactorily resolved until the emergence of the instant invention.

SUMMARY OF THE INVENTION

In accordance with the present invention, there is provided a protective cap attached to a musical instrument which is easily pivoted back and forth between a protective position and a playing position.

Further, according to this invention, a moistening means is provided in the protective cap to keep the reed moist when the cap is in the protective position.

A sleeve is placed on the musical instrument forward of the ligature. The sleeve is thin or ring-like and is tapered to conform with the taper of the mouthpiece. Two parallel protrusions or extensions extend from the sleeve. A cap, having a lip along both side edges and its outer end and a pair of pins or the like on its inner end, is pivotably mounted by such pins on the extensions. The cap is held in its protective position by a first pair of lugs on the inner end and is also held in its playing position by a second pair of lugs on the inner end. The cap is provided with a moistening means at its outer end. When in the protective position, this moistening means will help the reed retain its moisture.

The novel features which are considered as characteristic of the invention are set forth with particularity in the appended claims. The invention itself, however, as to its construction and obvious advantages will be best understood from the following description of the specific embodiment when read with the accompanying drawings.

DETAILED DESCRIPTION

Figure 1:
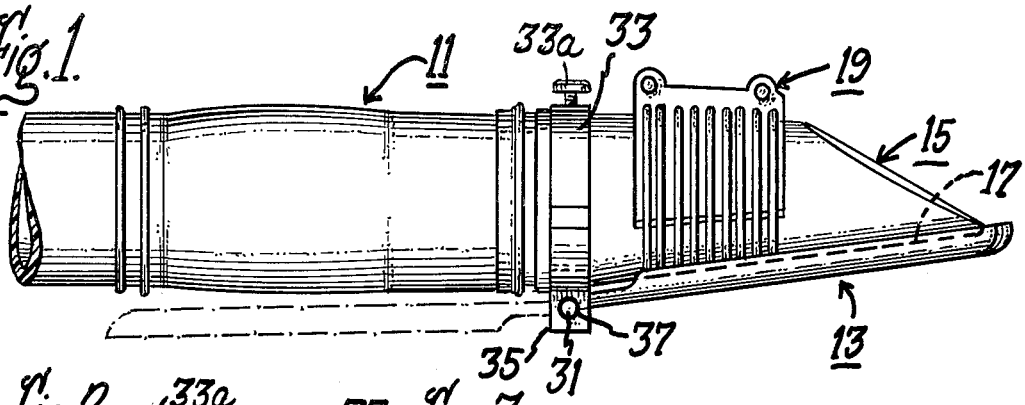
FIG. 1 is a side view of the cap attached to a woodwind instrument showing the cap in its protective position with its playing position shown in dotted lines.

Referring now to FIG. 1, a clarinet 11 is shown, but any other woodwind instrument, such as a saxophone, would utilize the reed protector in the same manner. A protective cap 13 extends over the mouthpiece 15 of the clarient 11 at the lower portion where the reed 17 is held in place by a ligature 19. A ligature 19 is shown in a general form attached to the mouthpiece 15 to hold the reed 17 in place. The ligature 19 and the protective cap 13, however, are distinct from one another and any ligature 19 may be used with the protective cap 13.

Figure 3:
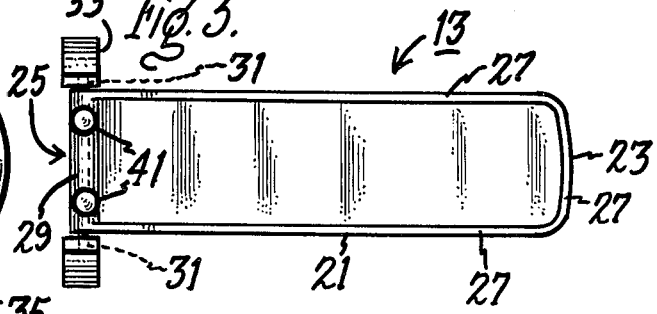
FIG. 3 is a top view of the protective cap.

Referring now to FIG. 3, the protective cap 13 has a generally rectangular shape having two substantially parallel side edges 21, a back or outer end 23 located at the mouthpiece which is referred to herein as the back of the instrument. The back end 23 is slightly rounded, as shown, to conform to the shape of the mouthpiece 15. A lip 27 extends around both a major portion of both side edges 21 and the back end 23. A forward or inner end 25 is pivotably mounted and, therefore, adjacent the inner end 25, there is no lip 27. The inner end 25 has a reinforced bar 29, preferably cast or molded as part of the protective cap 13, with pins 31 extending at each end from the reinforced bar 29.

Figure 2:
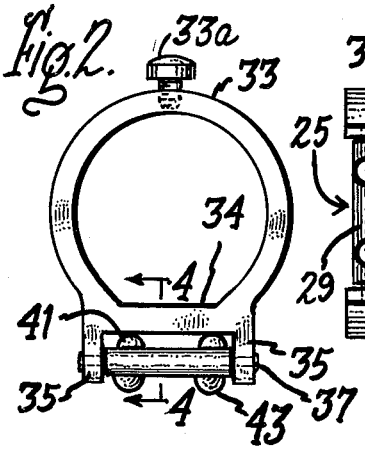
FIG. 2 is an end view of the sleeve.

A sleeve or ring 33 of narrow length, see FIGS. 1 and 2, is used to hold the protective cap 13 in place. The sleeve 33 is adapted to fit on the mouthpiece 15 of the woodwind instrument and accordingly has, when required, a lightly tapered interior consistent with the conical shape of the mouthpiece 15 of the woodwind instrument. The sleeve 33 has a circular interior cross-section but has a flat sector 34 to conform with the flat portion of the mouthpiece where the reed is located. The flat sector 34 is sufficiently remote from the center of the sleeve 33 that the sleeve 33 does not engage the reed 17 which is held by the ligature 19. Two small protrusions 35 extend downwardly from the sleeve 33 parallel to one another. The flat sector 34 is located substantially centrally between the protrusions 35. Each protrusion 35 has a circular opening 37 in it, located substantially centrally in the protrusion 35. As shown, pins 31 of cap 13 extend through openings 37, thus pivotally mounting cap 13 on ring 33. In the preferred embodiment a screw member **33*a* is provided to firmly secure sleeve 33 to the instrument 11**.

Figure 4:
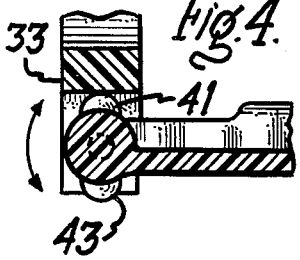
FIG. 4 is a partial sectional view along lines 4—4 of FIG. 2.

As can be seen, reinforced bar 29 is provided with two pair of lugs, 41 and 43, formed or mounted on opposite sides of such bar 29. Lugs 41, as best shown in FIG. 4, engage ring 33, when cap 13 is in the protective position, shown in full lines in FIG. 1. Lugs 43 will engage ring 33 when cap 13 is in the playing position, shown in dotted lines in FIG. 1. As will be apparent, when either pair of lugs, that is 41 or 43, engage ring 33, they will hold the cap 13 in either desired position. As earlier noted, the pins 31, which extend from reinforced bar 29, fit into opening 37, to pivotally mount cap 13 on ring 33. The pins 31 may be molded into the reinforced bar 29, and may be made of plastic or metal, as desired.

Modifications

Figure 5:
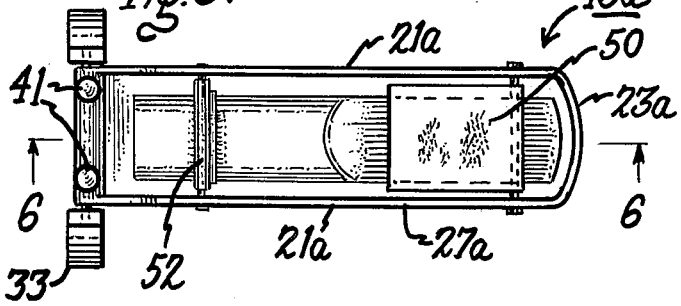
FIG. 5 is a top view of a modified form of the protective reed cap of this invention.
Figure 6:
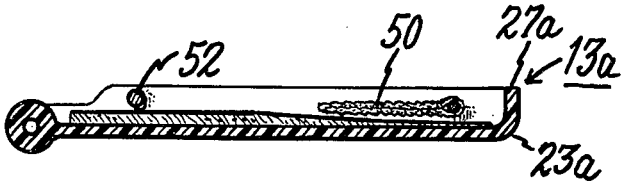
FIG. 6 shows a sectional side view of the modified form of protective cap according to this invention, taken on the line 6—6 of FIG. 5.

As earlier noted, various modifications may be made of the reed protector cap. Some of these embodiments are shown in FIGS. 5 and 6. Referring now to those FIGURES, a modified protective cap is shown in which moistening means are provided to maintain the reed moist when not in use, for example during intermission. A reed protector cap **13*a* is shown having a back end 23*a* and parallel side edges 21*a*, having a lip 27*a* extending around a major portion of both side edges 21*a* and the back end 23*a*. A moistening means in the form of a foam member 50 is provided at the back end 23*a***, positioned to engage the reed (not shown) of the woodwind instrument, As will be apparent, when the foam is moistened it will aid in maintaining the reed of the woodwind instrument moist.

A further embodiment illustrated in FIGS. 5 and 6 is a means to hold an extra reed in the protective cap. In this instance, an eccentric member 52 is provided at the end opposite the moistening means. Additionally, the moistening means is placed on a pivot, such that it may be pivoted, as indicated in FIG. 6, to allow the extra reed to be placed in the cap. As will be understood, both the eccentric 52 and the moistening device 50 will aid in holding the reed in the cap 13. Also, the moistening device will keep the extra reed moist, so that it may be used when desired or necessary. It will be apparent that foam member 50 may be secured to a perforated piece of plastic to make it more readily movable.

Figure 7:
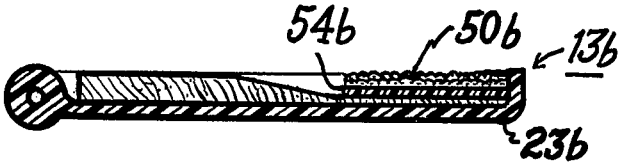
FIG. 7 is a sectional view similar to FIG. 6, but on a slightly enlarged scale, showing another modification of this invention.

FIG. 7 shows a further embodiment in which protector cap **13*b* has a foam member 50*b* secured to a rigid member 54*b*, such as plastic. An extra reed may be readily slid under the rigid member 54*b*. Due to the slope of the reed and its curvature, it is wedged flat against the protector cap 13*b*. As above noted, the rigid member 54*b*** may be perforated to moisten the extra reed.

The invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning and range of equivalency of the claims are, therefore, intended to be embraced therein.

I claim:

1. An improved reed protector for a mouthpiece of a woodwind instrument utilizing a reed held by a ligature, said instrument having a back end where the mouthpiece is located and a forward end opposite from said mouthpiece, said improvement comprising:

a sleeve adapted to slip fit over the mouthpiece of a woodwind instrument, and to be located on the mouthpiece adjacent and separate from the ligature toward the forward end of said instrument, the interior of said sleeve being generally circular, a pair of protrusions, parallel to one another and extending from the exterior of said sleeve, each of said protrusions having interior surfaces which face each other, the interior of said sleeve including a flat sector located between said pair of protrusions for providing clearance between said sleeve and said reed;

a unitary protective cap having a back end and a forward end with two substantially parallel sides extending between the back end and the forward end, said protective cap being rotatably mounted on the pair of protrusions, and being adapted to be held in its protective position over the reed on the mouthpiece and being adapted to be held in its playing position away from the reed and on the instrument;

each of said protrusions having an opening therein;

said unitary protective cap having a reinforced bar at its forward end, said reinforced bar having pins extending from each end, said pins mounted in said openings on said protrusions for rotatably mounting said unitary protective cap;

said reinforced bar having two pair of lugs thereon, one pair of lugs engaging a portion of said sleeve between said protrusions to hold said protective cap in its protective position, the other pair of lugs engaging a portion of said sleeve between said protrusions to hold said protective cap in its playing position.

2. An improved reed protector as claimed in claim 1 in which a foam member is provided at the back end of said protective cap to enable moistening of the reed when said protective cap is in its protective position.

* * * * *